US005522508A

United States Patent [19]

Pesola

[11] Patent Number: 5,522,508

[45] Date of Patent: Jun. 4, 1996

[54] GAME CARRYING AND STORAGE SYSTEM

[76] Inventor: Bruce E. Pesola, 6001 Bahia Del Mar Cir., #225, St. Petersburg, Fla. 33715

[21] Appl. No.: 422,707

[22] Filed: Apr. 14, 1995

[51] Int. Cl.[6] ..... B65D 25/10

[52] U.S. Cl. ..... 206/579; 206/315.1; 206/472; 402/502

[58] Field of Search ..... 206/232, 315.1, 206/387.13, 472, 579; 273/148 R; 402/74, 77, 79, 502

[56] References Cited

U.S. PATENT DOCUMENTS

| | | | |
|---|---|---|---|
| 1,659,588 | 2/1928 | Balmforth | 206/315.1 |
| 4,255,872 | 3/1981 | Williams, Sr. | 206/232 |
| 4,415,081 | 11/1983 | Goncalves . | |
| 4,588,321 | 5/1986 | Egly . | |
| 4,778,047 | 10/1988 | Lay . | |
| 4,823,950 | 4/1989 | Roze | 206/472 |
| 4,844,260 | 7/1989 | Jaw | 206/472 |
| 4,848,585 | 7/1989 | Snyder | 206/472 |
| 4,913,283 | 4/1990 | Stühn . | |
| 5,161,907 | 11/1992 | Byrne | 206/472 |
| 5,193,681 | 3/1993 | Lievsay . | |
| 5,445,264 | 8/1995 | Uchida | 206/232 |

*Primary Examiner*—Jimmy G. Foster
*Attorney, Agent, or Firm*—James E. Larson; Herbert W. Larson

[57] ABSTRACT

A game carrying and storage system is provided for enclosing, carrying, and maintaining games in an organized manner. A carrying case has a ring binder mounted within the case for retaining multiple game pages. The game pages hold all the pieces of a particular game. The game pages are removable from the carrying case permitting an individual to substitute different games within the system. The game pages additionally have a closure and securing means for keeping the pages closed and secured prohibiting the game pieces from spilling out.

20 Claims, 4 Drawing Sheets

Fig. 8
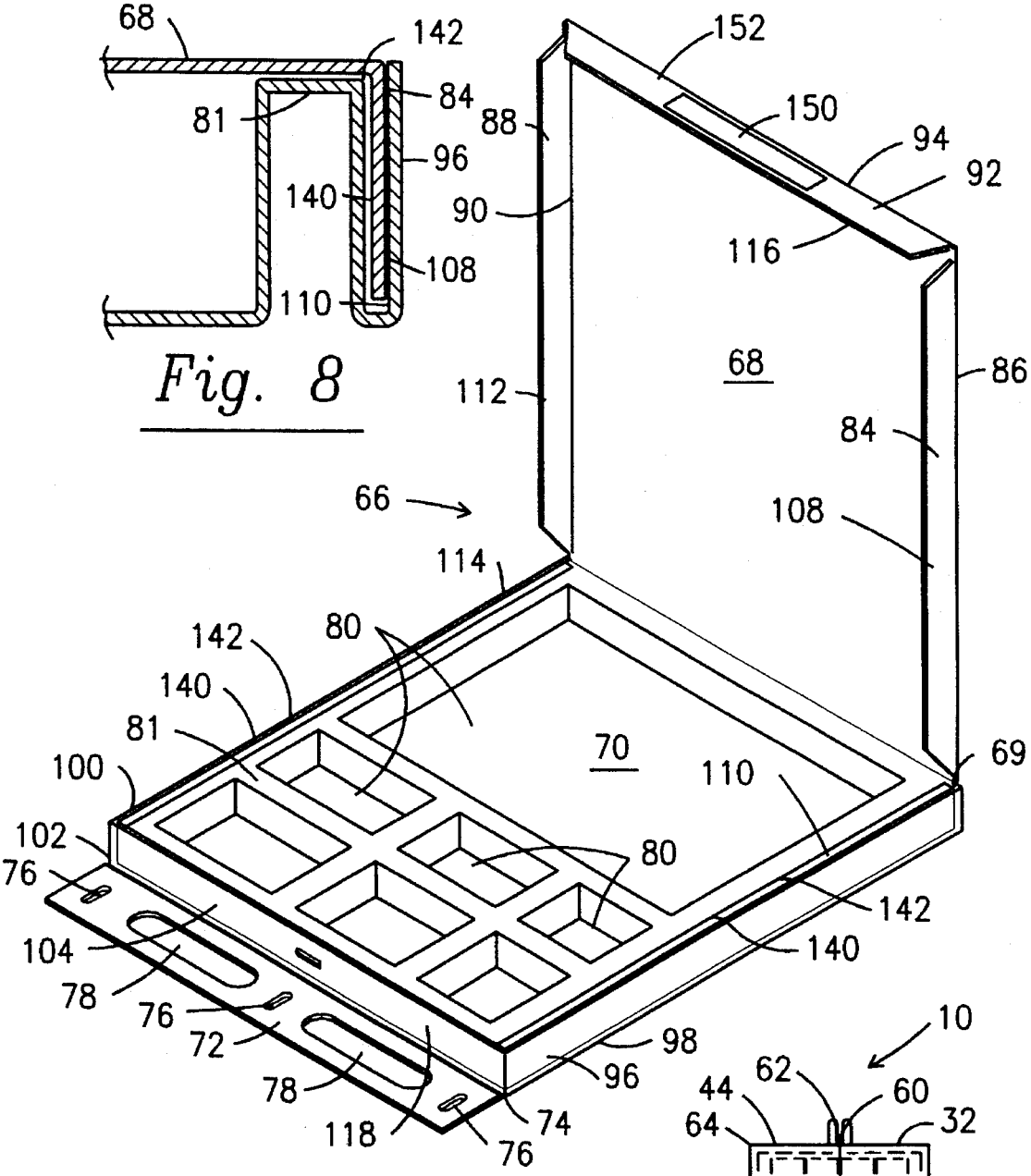
Fig. 9
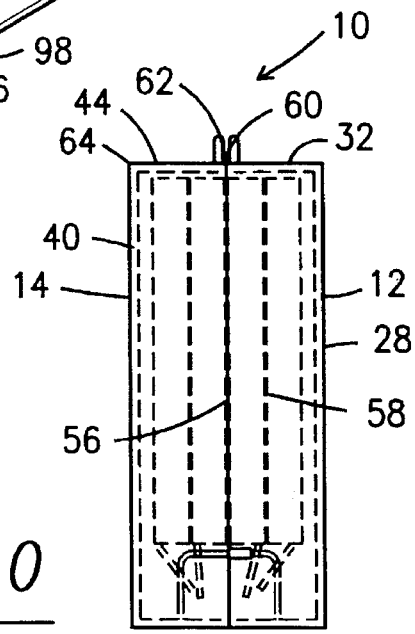
Fig. 10

GAME CARRYING AND STORAGE SYSTEM

BACKGROUND OF THE INVENTION

1. Field of the Invention

This invention relates to storage and carrying case. More particularly, it relates to a system for conveniently carrying and storing games.

2. Description of Prior Art

Carrying cases are well known in the prior art and have been used for a wide variety of items. Some carrying cases are used for transporting items while others are used for storing items. Some cases merely enclose items for organizational purposes. Depending on the articles enclosed within the case, a variety of structural elements can be employed with the case for maintaining he articles in a fixed position. If one wants to transport the case, the use of elements to maintain the articles in a fixed position is desirable.

Many U. S. Patents have been issued for carrying cases enclose a wide variety of items. U.S. Pat. No. 4,415,081 discloses a case for carrying phonograph albums, while U. S. Pat. No. 4,913,283 discloses a case for drawing boards. Each of these devices has developed to solve a specific problem with a specific article.

Recently a number of U.S. Patents have been used devices for enclosing carrying, and storing magnetic media in an effort to keep magnetic media organized and away from damaging elements. Some of these devices can be seen in U.S. Pat. Nos. 4,588,321, 4,778,047, and 5,193,681. All of the devices disclosed in these patents are specifically used with magnetic media. All of these devices have been developed to solve yet another specific problem; namely, maintaining magnetic media in an organized and safe state.

One soon realizes that individuals are continually inventing new carrying cases for enclosing and storing numerous different articles. There exists a need for new carrying cases for enclosing, storing, and transporting articles that do not yet have a carrying case. One example is a carrying case for games.

SUMMARY OF THE INVENTION

I have invented a unique carrying case and storage system for games. My system allows for compact storage of numerous games and game pieces and the subsequent transporting of those games through the use of a single carrying case. My system encloses the games and game pieces in an organized and fixed position.

The system carrying case has a front and rear cover, integrally attached skirts extending from peripheral edges of the front and rear covers providing side walls, and a binder portion attached to the front and rear covers by hinges. The front and rear covers pivot along the hinges permitting the case to open and close. The carrying case is completely sealed when it is closed. A lockable ring mechanism attaches along an inside surface of the binder for retaining game pages. The pages are formed from a molded bottom plate having cavities for retaining pieces of the games and a top sheet covering the bottom plate. A closure mechanism disposed along an inner end of the game page secures the top sheet over the bottom plate in a fixed position prohibiting any of the game pieces from falling out of the cavities. Specific plates can be provided for retaining specific games wherein cavities in the molded bottom plate frictionally retain specific game pieces. Likewise, generic plates can be provided having a plurality of cavities formed therein for retaining game pieces of a multiplicity of different games.

BRIEF DESCRIPTION OF THE DRAWINGS

The invention may be best understood by those having ordinary skill in the art by reference to the following detailed description when considered in conjunction with the accompanying drawings in which:

FIG. 8 is a cross-sectional view of a game page along lines 8—8 of FIG. 5;

FIG. 9 is a perspective view of a game page employed with the carrying case of the present invention;

FIG. 10 is a left side elevational view of the carrying case in an closed position.

DETAILED DESCRIPTION OF THE INVENTION

Figures 1, 2, 3, 4:
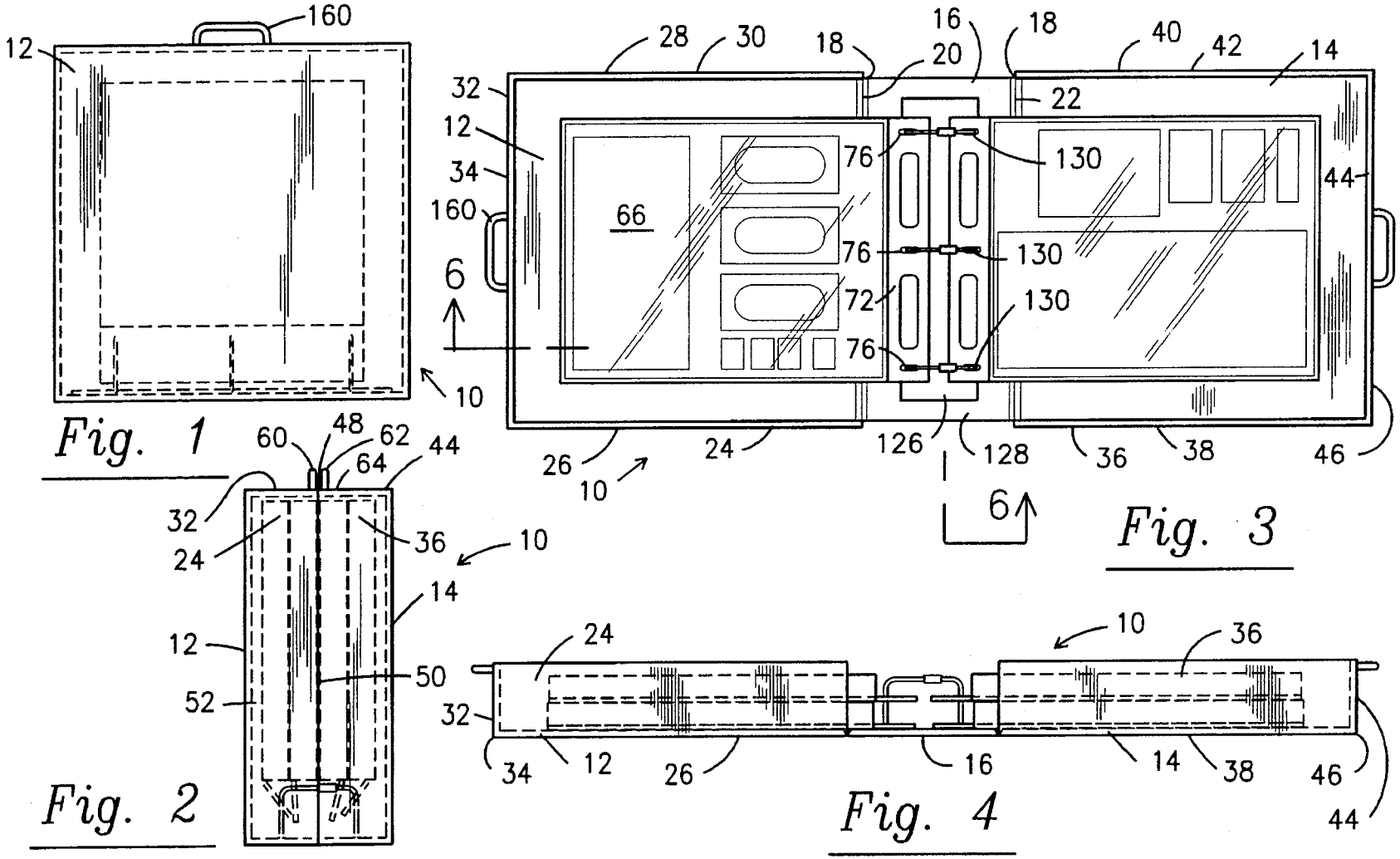
FIG. 1 is a front view of a carrying case employed in the system of the present invention shown in a closed position.
FIG. 2 is a right side elevational view of the carrying case in an closed position.
FIG. 3 is a top plan view of the carrying case in an open position.
FIG. 4 is a right side elevational view of the carrying case in an open position.

Throughout the following detailed description, the same reference numerals refer to the same elements in all figures.

Referring to FIG. 1, a carrying case 10 of the present invention is shown in a closed position from a front view. Referring to FIG. 3, case 10 is shown in an open position from a top plan view. Further to FIG. 3, case 10 has a front and rear cover 12 and 14 respectively. A binder portion 16 is attached intermediate front and rear covers 12 and 14 by hinges 18 along opposed inner edges 20 and 22 of front and rear covers 12 and 14 respectively. Hinges 18 permit front and rear covers 12 and 14 to fold over so that case 10 can be closed.

Referring to FIG. 2, case 10 is shown in a right side elevational view illustrating how case 10 is completely sealed when closed. Referring to FIG. 4, case 10 is shown in an open position from a right elevational view. Case 10 has a plurality of upwardly extending skirts integrally attached along peripheral edges of front and rear covers 12 and 14 which permit case 10 to be completely sealed. As shown in FIG. 3, a first right skirt 24 attaches along a first right peripheral edge 26 of front cover 12, a first left skirt 28 attaches along a first left peripheral edge 30 of front cover 12, and a first top skirt 32 attaches along a first top peripheral edge 34 of front cover 12. Further to FIG. 3, a second right skirt 36 attaches along a second right peripheral edge 38 of rear cover 14, a second left skirt 40 attaches along a second left peripheral edge 42 of rear cover 14, and a second top skirt 44 attaches along a second top peripheral edge 46 of rear cover 14.

When case 10 is closed, first and second right skirts 24 and 36 meet at opposed rims 48 and 50 respectively to provide a right side wall 52 to case 10 when closed, as shown in FIG. 2; the first and second right skirts 24 and 36 each represent one half of case right side wall 52. First and second left skirts 28 and 40 meet at opposed rims 54 and 56 respectively to provide a left side wall 58 to case 10 when closed, as shown in FIG. 10.; the first and second left skirts 28 and 40 each represent one half of case left side wall 58. First and second top skirts 32 and 44 meet at opposed rims 60 and 62 respectively to provide a top wall 64 when case 10 is closed, as shown in FIGS. 2 and 10; first and second top skirts 32 and 44 each represent one half of case top wall 64.

Figure 11:
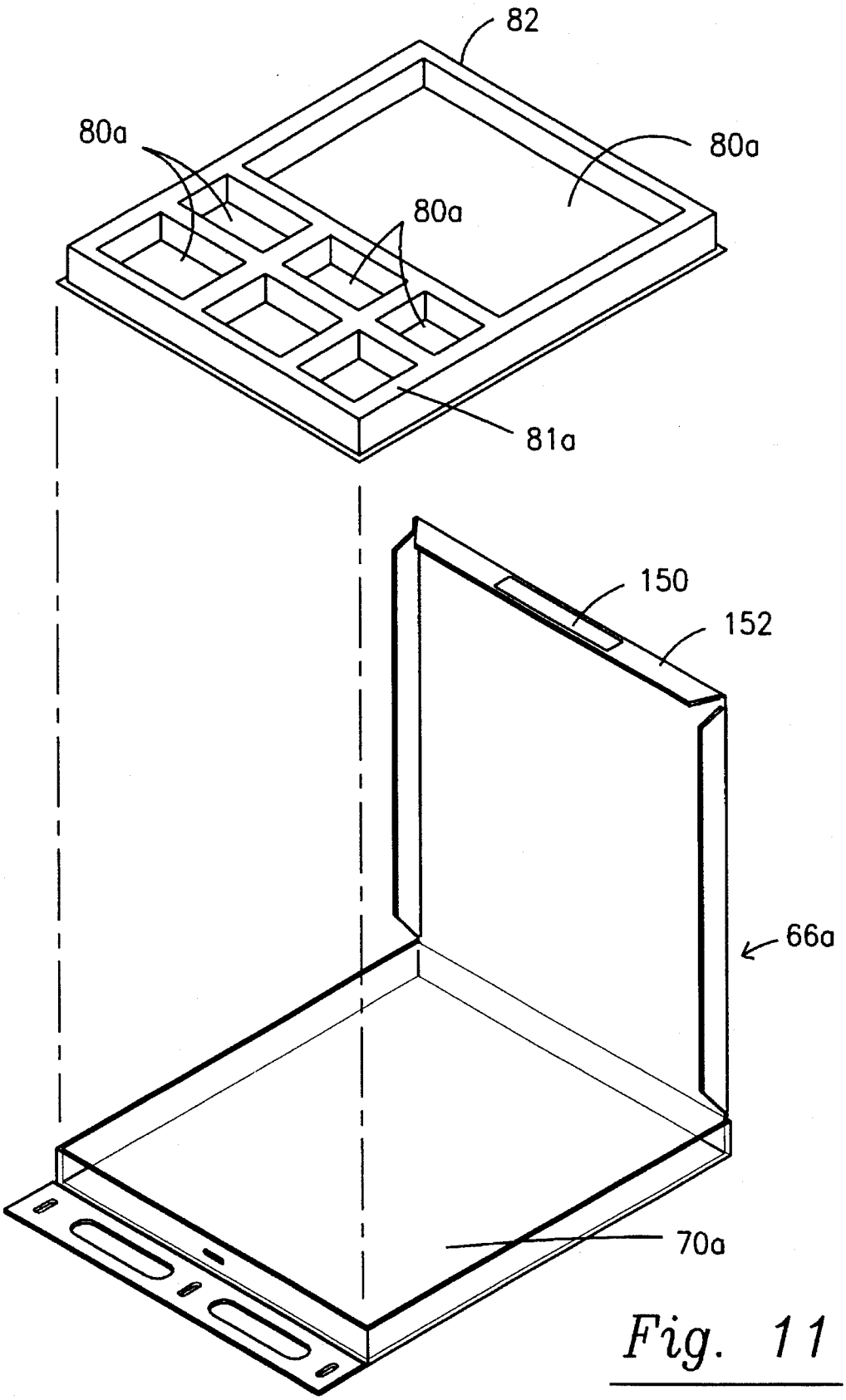
FIG. 11 is a perspective view of an alternate game page having a removable molded insert positionable within the game page bottom plate.

Referring to FIG. 3, a game page 66 used with the present invention is shown. Referring to FIG. 9, game page 66 has a top sheet 68 pivotly attached to a bottom plate 70 by an outer hinge 69 and a lip portion 72 pivotly attached to bottom plate 70 by an inner hinge 74. The preferred embodiment of FIG. 9 employs a living hinge for inner hinge 74. Lip portion 72 has three first generally oblong holes 76 formed therein and positioned perpendicular to an axis parallel to inner hinge 74. Further, lip portion 72 has a pair of second generally oblong holes 78 formed therein and positioned parallel to an axis parallel to inner hinge 74 providing a grasping means for game page 66. A plurality of cavities 80 are positioned within bottom plate 70 for retaining game pieces. The material remaining after cavities 80 have been formed constitutes a cavity frame 81. In the preferred embodiment of FIG. 9, the cavities 80 are formed in bottom plate 70. In an alternate embodiment, depicted in FIG. 11, a plurality of cavities **80*a* are formed in an removable insert 82 having a cavity frame 81*a* positioned within a bottom plate 70*a* of an alternate game page 66*a*. All remaining elements of alternate game page 66*a* are identical to preferred game page 66**.

The system of the present invention provides for cavities 80 to be formed specifically for certain games. For example, the system can be provided with game pages 66 which have the exact number and the appropriate sized cavities for retaining games such as Monopoly®, Trivial Pursuit®, Pictionary®, Scrabble®, Scattergories®, as well as games with a known set of pieces such as checkers, chess, backgammon, and darts. Further, the system of the present invention can be marketed with a game pre-packaged within the game pages 66. Therefore, upon purchasing the game, the buyer simply inserts the game page 66 retaining the game into the carrying case 10. Still further, the system of the present invention can provide game pages 66 for retaining pieces of games that include compact discs, cassettes, and video tapes. Still even further, game page 66 can provide a plurality of cavities 80 formed for retaining a plurality of playing cards. Different types of playing cards can be retained, including a traditional set of 52 playing cards, Fish®, Old Maid®, and other card games using a proprietary set of cards as its game pieces.

Referring to FIG. 9, a plurality of downwardly extending flanges of top sheet 68 communicate with a plurality of upwardly extending walls of bottom sheet 70 to provide a closure means for closing game page 66. A right downwardly extending flange 84 integrally attaches along a first right side edge 86 of top sheet 68, a left downwardly extending flange 88 integrally attaches along a first left side edge 90 of top sheet 68, and a top downwardly extending flange 92 integrally attaches along a first top side edge 94 of top sheet 68. A right upwardly extending wall 96 integrally attaches along a second right side edge 98 of bottom plate 70, a left upwardly extending wall 100 integrally attaches along a second left side edge 102 of bottom plate 70, and a top upwardly extending wall 104 integrally attaches along a second top side edge 106 of bottom plate 70, proximal to inner hinge 74.

Figure 5:
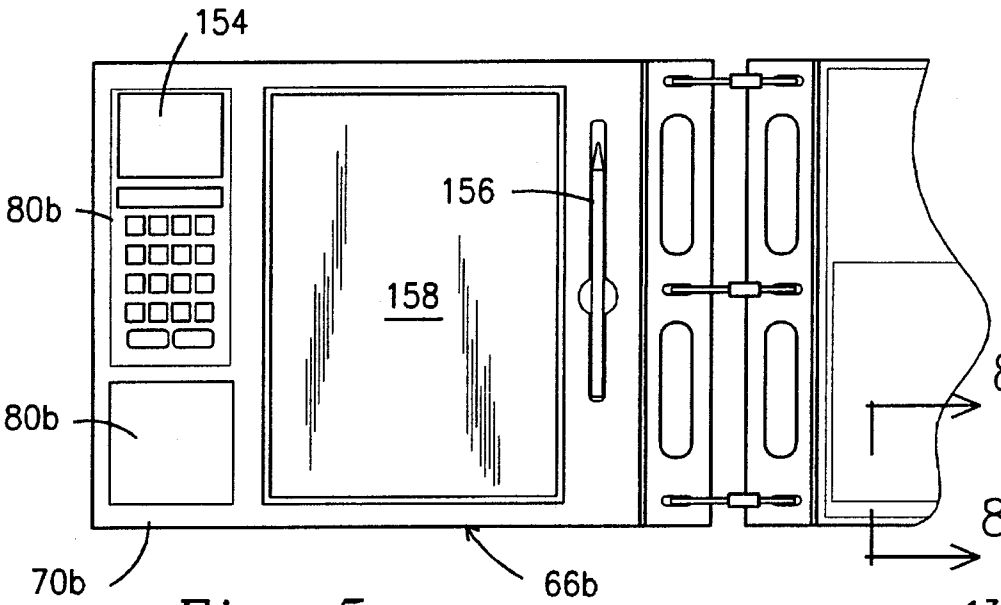
FIG. 5 is a partial top plan view of a score sheet game page employed with the system of the present invention.

Referring to FIG. 9, top sheet 68 is folded down upon bottom sheet 70 to close game page 66 such that an outer surface 108 of right downwardly extending flange 84 lays juxtaposed to an inner surface 110 of right upwardly extending wall 96, an outer surface 112 of left downwardly extending flange 88 lays juxtaposed to an inner surface 114 of left upwardly extending wall 100, and an inner surface 116 of top downwardly extending flange 92 lays juxtaposed to an outer surface 118 of top upwardly extending wall 104. Further, a channel 140 formed between an outer portion 142 of cavity frame 81 and inner surfaces 110 and 114 of right and left upwardly extending walls 96 and 100 respectively receives flanges 84 and 88 such that pressure exerted outwardly by flanges 84 and 88 against walls 96 and 100 respectively permits game page 66 to remain generally closed. Referring to FIG. 8, a cross-sectional view along lines 8—8 of FIG. 5, illustrates the positioning of right downwardly extending flange 84 within channel 140 between cavity frame 81 and inner surface 110 of right upwardly extending wall 96.

Figure 6:
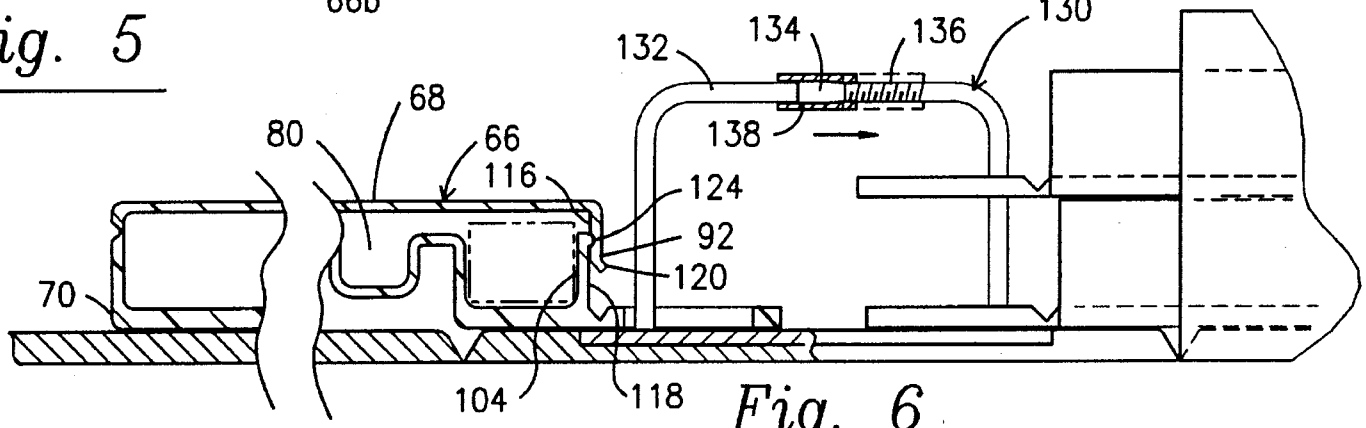
FIG. 6 is a partial cross-sectional right side elevational view of the carrying case, the cross-sectional view taken along line 6 of FIG. 3.

Referring to FIG. 6, a detent lock 120 is provided for fixedly securing top sheet 68 to bottom plate 70. Once game page 66 is securely locked by detent lock 120, game pieces are prevented from escaping therefrom as well as the game pieces being retained within their respective cavity 80. Detent lock 120 has a ridge 122 integrally attached to outer surface 118 of top upwardly extending wall 104 for frictionally engaging a groove 124 formed in inner surface 116 of top downwardly flange 92.

Referring to FIG. 3, a ring binder 126 mechanism is mounted on an inside surface 128 of binder 16 of carrying case 10. Ring binder 126 has three lockable rings 130 inserting through the three first generally oblong holes 76 respectively formed in the lip portion 72 of game page 66 for maintaining game page 66 within carrying case 10. Referring to FIG. 6, each ring 130 has a bar 132, a broken section 134, a threaded portion 136 positioned proximal to broken section 134 and in axial alignment with bar 132, and a threaded nut 138 slidable along bar 132 for engaging threaded portion 136 thereby covering broken section 134. Broken section 134 permits game page 66 to be inserted and removed from ring binder 126. The preferred embodiment employs rings 130 of sufficient size to retain four game pages 66, as shown in FIG. 4. Other rings of different sizes can be used to retain more than four game pages.

Figure 7:
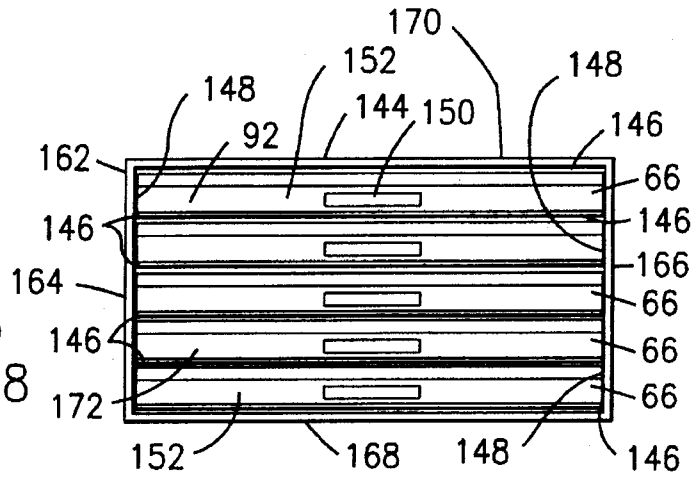
FIG. 7 is a top plan view of a storage case employed with the system of the present invention.

Referring to FIGS. 1 and 3, carrying case 10 is provided with a handle 160 for facilitating movement of carrying case 10 such that it can he carried like a suitcase. Referring to FIG. 7, an alternate storage case 144 is provided. Storage case 144 permits an individual to possess more game pages than can fit within carrying case 10. Accordingly, game pages 66 can be removed and stored with storage case 144. Storage case 144 has a bottom portion 162, a pair of opposed left and right side portions 164 and 166 respectively, opposed front and rear portions 168 and 170 respectively, an open top portion 172, and a set of outwardly projecting tabs 146 mounted along an inner surface 148 permitting game pages 66 to slide in and out of case 144 while remaining in an aligned and fixed position. Removal of a game page will not cause other remaining game pages to fall within case 144. The pair of generally oblong holes 78 formed in lip portion 72 of game page 66, shown in FIG. 9, permit an individual to grasp game page 66 with both hands. A label 150 affixed along an outer surface 152 of top downwardly extending flange 92 permits a user of the system to label his or her games for easy categorizing.

Referring to FIG. 5, a second alternate game page **66*b* is provided having game scoring materials inserted therein. All elements of second alternate game page 66B are identical to preferred game page 66 except for the following elements set forth below. Second alternate game page 66*b* has an electronic scoring machine 154 inserted in a cavity 80*b* formed in a bottom plate 70*b*. Electronic scoring machine can provide electronic dice, an electronic pad, an electronic calculator, and an electronic timer. The preferred manner to insert electronic scoring machine 154 is by friction although it can be permanently embedded. Additionally provided in second alternate game page 66*b* are a writing implement 156, a writing pad 158, and spare cavities 80*b*** for retaining other useful game pieces such as dice and playing cards.

Equivalent elements can be substituted for the ones set forth above to achieve the same results in the same manner.

Having thus described the invention what is claimed and desired to be secured by Letters Patent is:

1. A game carrying and storage system comprising, a carrying case having a front and rear cover, a binder portion attached to the front and rear cover by hinges along opposed inner edges of the front and rear cover, and a plurality of upwardly extending skirts attached along peripheral edges of the front and rear cover, the plurality of upwardly extending skirts providing a top and a pair of opposed side walls to the carrying case when the case is closed, a plurality of game pages, each game page having a top sheet and a bottom plate, a plurality of cavities formed in the bottom plate, a lip portion pivotly attached to the game page at an inner hinge of the game page, a plurality of holes formed in the lip portion, closure means disposed along a front and opposed sides of the top sheet and bottom plate for closing the game page, and securing means disposed along the front side of the top sheet and bottom plate for securing the top sheet to the bottom plate, and a page retaining mechanism mounted to an inside surface of the carrying case binder portion and having a plurality of lockable rings inserting through the plurality of holes formed in the lip portion retaining the game pages within the carrying case.

2. The game carrying and storage system according to claim 1, wherein there are three first upwardly extending skirts attached along the carrying case front cover peripheral edges and three second upwardly extending skirts attached along the carrying case rear cover peripheral edges.

3. The game carrying and storage system according to claim 2, wherein a first right upwardly extending skirt is integrally attached along a first right peripheral edge of the front cover, a first left upwardly extending skirt is integrally attached along a first left peripheral edge of the front cover, a first top upwardly extending skirt is integrally attached along a first top peripheral edge of the front cover, a second right upwardly extending skirt is integrally attached along a second right peripheral edge of the rear cover, a second left upwardly extending skirt is integrally attached along a second left peripheral edge of the rear cover, and a second top upwardly extending skirt is integrally attached along a second top peripheral edge of the rear cover.

4. The game carrying and storage system according to claim 1, wherein the closure means of the game page is a plurality of downwardly extending flanges of the top sheet communicating with a plurality of upwardly extending walls of the bottom plate.

5. The game carrying and storage system according to claim 4, wherein a right downwardly extending flange integrally attaches along a first right side edge of the top sheet, a left downwardly extending flange integrally attaches along a first left side edge of the top sheet, a top downwardly extending flange integrally attaches along a first top edge of the top sheet, a right upwardly extending wall integrally attaches along a second right side edge of the bottom plate, a left upwardly extending wall integrally attaches along a second left side edge of the bottom plate, and a top upwardly extending wall integrally attaches along a second front edge of the bottom plate.

6. The game carrying and storage system according to claim 5, wherein an outer surface of the right downwardly extending flange lays juxtaposed to an inner surface of the right upwardly extending wall, an outer surface of the left downwardly extending flange lays juxtaposed to an inner surface of the left upwardly extending wall, and an inner surface of the top downwardly extending flange lays juxtaposed to an outer surface of the top upwardly extending wall when the game page is closed.

7. The game carrying and storage system according to claim 1, wherein the securing means is a detent lock having a groove frictionally receiving a ridge.

8. The game carrying and storage system according to claim 7, wherein the groove is formed in an inner surface of a top downwardly extending flange of the top sheet and the ridge is attached to an outer surface of a top upwardly extending wall of the bottom plate.

9. The game carrying and storage system according to claim 1, wherein there are three holes formed in the game page lip portion.

10. The game carrying and storage system according to claim 1, wherein there are three lockable rings.

11. The game carrying and storage system according to claim 1, wherein each of the plurality of lockable ring comprises a bar having a broken section, a threaded portion, and a threaded nut slidable along the bar engaging the bar threaded portion and covering the bar broken section.

12. A game carrying and storage system comprising, a carrying case having a front and rear cover, a binder portion attached to the front and rear cover by hinges along opposed inner edges of the front and rear cover, three first upwardly extending skirts attached along peripheral edges of the front cover, and three second upwardly extending skirts attached along peripheral edges of the rear cover, the three upwardly extending skirts of the front and rear covers providing a top and a pair of opposed side walls to the carrying case when the case is closed, a plurality of game pages, each game page having a top sheet and a bottom plate, a plurality of cavities formed in the bottom plate, a cavity frame surrounding the plurality of cavities, a lip portion pivotly attached to the game page at an inner hinge of the game page, three holes formed in the lip portion, closure means disposed along a front and opposed sides of the top sheet and bottom plate for closing the game page, and securing means disposed along the front side of the top sheet and bottom plate for securing the top sheet to the bottom plate, and a page retaining mechanism mounted to an inside surface of the carrying case binder portion and having three lockable rings inserting through the three holes respectively formed in the lip portion retaining the game pages within the carrying case, each of the three lockable rings having a bar having a broken section, a threaded portion, and a threaded nut slidable along the bar engaging the bar threaded portion and covering the bar broken section.

13. The game carrying and storage system according to claim 12, wherein the cavity frame is removable.

14. The game carrying and storage system according to claim 12, wherein the closure means comprises a right downwardly extending flange integrally attaching along a first right side edge of the top sheet, a left downwardly extending flange integrally attaching along a first left side edge of the top sheet, a top downwardly extending flange integrally attaching along a first top edge of the top sheet, a right upwardly extending wall integrally attaching along a second right side edge of the bottom plate, a left upwardly extending wall integrally attaching along a second left side edge of the bottom plate, and a top upwardly extending wall integrally attaching along a second front edge of the bottom plate.

15. The game carrying and storage system according to claim 14, wherein an outer surface of the right downwardly extending flange lays juxtaposed to an inner surface of the right upwardly extending wall, an outer surface of the left downwardly extending flange lays juxtaposed to an inner surface of the left upwardly extending wall, and an inner surface of the top downwardly extending flange lays juxtaposed to an outer surface of the top upwardly extending wall when the game page is closed.

16. The game carrying and storage system according to claim 12, wherein the securing means is a detent lock having a groove formed in an inner surface of a top downwardly extending flange of the top sheet frictionally receiving a ridge attached to an outer surface of a top upwardly extending wall of the bottom plate.

17. The game carrying and storage system according to claim 12, further comprising a storage box having a bottom portion, a pair of opposed side portions, opposed front and rear portions, an open top end, an inner surface, and a plurality of tabs attached along the inner surface forming a plurality of slots, the slots retaining the game pages removed from the carrying case.

18. A game carrying and storage system comprising, a carrying case having a front and rear cover, a binder portion attached to the front and rear cover by hinges along opposed inner edges of the front and rear cover, three first upwardly extending skirts attached along peripheral edges of the front cover, and three second upwardly extending skirts attached along peripheral edges of the rear cover, the three upwardly extending skirts of the front and rear covers providing a top and a pair of opposed side walls to the carrying case when the case is closed, a plurality of game pages, each game page having a top sheet and a bottom plate, a plurality of cavities formed in the bottom plate, a cavity frame surrounding the plurality of cavities, a lip portion pivotly attached to the game page at an inner hinge of the game page, three holes formed in the lip portion, a right downwardly extending flange integrally attaching along a first right side edge of the top sheet, a left downwardly extending flange integrally attaching along a first left side edge of the top sheet, a top downwardly extending flange integrally attaching along a first top edge of the top sheet, a right upwardly extending wall integrally attaching along a second right side edge of the bottom plate, a left upwardly extending wall integrally attaching along a second left side edge of the bottom plate, a top upwardly extending wall integrally attaching along a second front edge of the bottom plate, a detent lock having a groove formed in an inner surface of a top downwardly extending flange of the top sheet frictionally receiving a ridge attached to an outer surface of a top upwardly extending wall of the bottom plate, and grasping means formed in the lip portion, and a page retaining mechanism mounted to an inside surface of the carrying case binder portion and having three lockable rings inserting through the three holes respectively formed in the lip portion retaining the game pages within the carrying case, each of the three lockable rings having a bar having a broken section, a threaded portion, and a threaded nut slidable along the bar engaging the bar threaded portion and covering the bar broken section.

19. The game carrying and storage system according to claim 18, wherein the cavity frame is removable.

20. The game carrying and storage system according to claim 18, wherein an outer surface of the right downwardly extending flange lays juxtaposed to an inner surface of the right upwardly extending wall, an outer surface of the left downwardly extending flange lays juxtaposed to an inner surface of the left upwardly extending wall, and an inner surface of the top downwardly extending flange lays juxtaposed to an outer surface of the top upwardly extending wall when the game page is closed.

* * * * *